US008913940B2

(12) United States Patent
Sawamura

(10) Patent No.: US 8,913,940 B2
(45) Date of Patent: Dec. 16, 2014

(54) FIXING DEVICE AND IMAGE FORMING APPARATUS

(71) Applicant: Fuji Xerox Co., Ltd., Minato-ku, Tokyo (JP)

(72) Inventor: Jun Sawamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 79 days.

(21) Appl. No.: 13/680,936

(22) Filed: Nov. 19, 2012

(65) Prior Publication Data

US 2013/0315638 A1 Nov. 28, 2013

(30) Foreign Application Priority Data

May 22, 2012 (JP) ..... 2012-116807

(51) Int. Cl.
*G03G 15/20* (2006.01)

(52) U.S. Cl.
CPC ..... *G03G 15/2003* (2013.01)
USPC ..... 399/333; 399/335; 399/339; 399/97; 399/70; 399/122

(58) Field of Classification Search
USPC ..... 399/333, 335, 39, 97, 70, 122
See application file for complete search history.

(56) References Cited

U.S. PATENT DOCUMENTS 6,390,683 B1 5/2002 Hirose et al.
2007/0092311 A1* 4/2007 Fujimoto ..... 399/328

FOREIGN PATENT DOCUMENTS

JP 2001-051534 A 2/2001
JP 2007-025379 A 2/2007
JP 2008-052182 A 3/2008

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A fixing device includes a solid or hollow cylindrical heating member that heats a recording medium and has recesses or projections provided at axial ends thereof, over the entire outer circumferences; ring-shaped heat insulating members to be fitted to the axial ends of the heating member, the ring-shaped heat insulating members having, in the inner circumferences thereof, projections or recesses that fit into or receive the recesses or projections provided on the heating member; and bearings that rotatably support the axial ends of the heating member via the heat insulating members.

10 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-116807 filed May 22, 2012.

BACKGROUND

Technical Field

The present invention relates to a fixing device and an image forming apparatus.

SUMMARY

According to an aspect of the invention, there is provided a fixing device including a solid or hollow cylindrical heating member that heats a recording medium and has recesses or projections provided at axial ends thereof, over the entire outer circumferences; ring-shaped heat insulating members to be fitted to the axial ends of the heating member, the ring-shaped heat insulating members having, in the inner circumferences thereof, projections or recesses that fit into or receive the recesses or projections provided on the heating member; and bearings that rotatably support the axial ends of the heating member via the heat insulating members.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Configuration of Image Forming Apparatus

Figure 1:
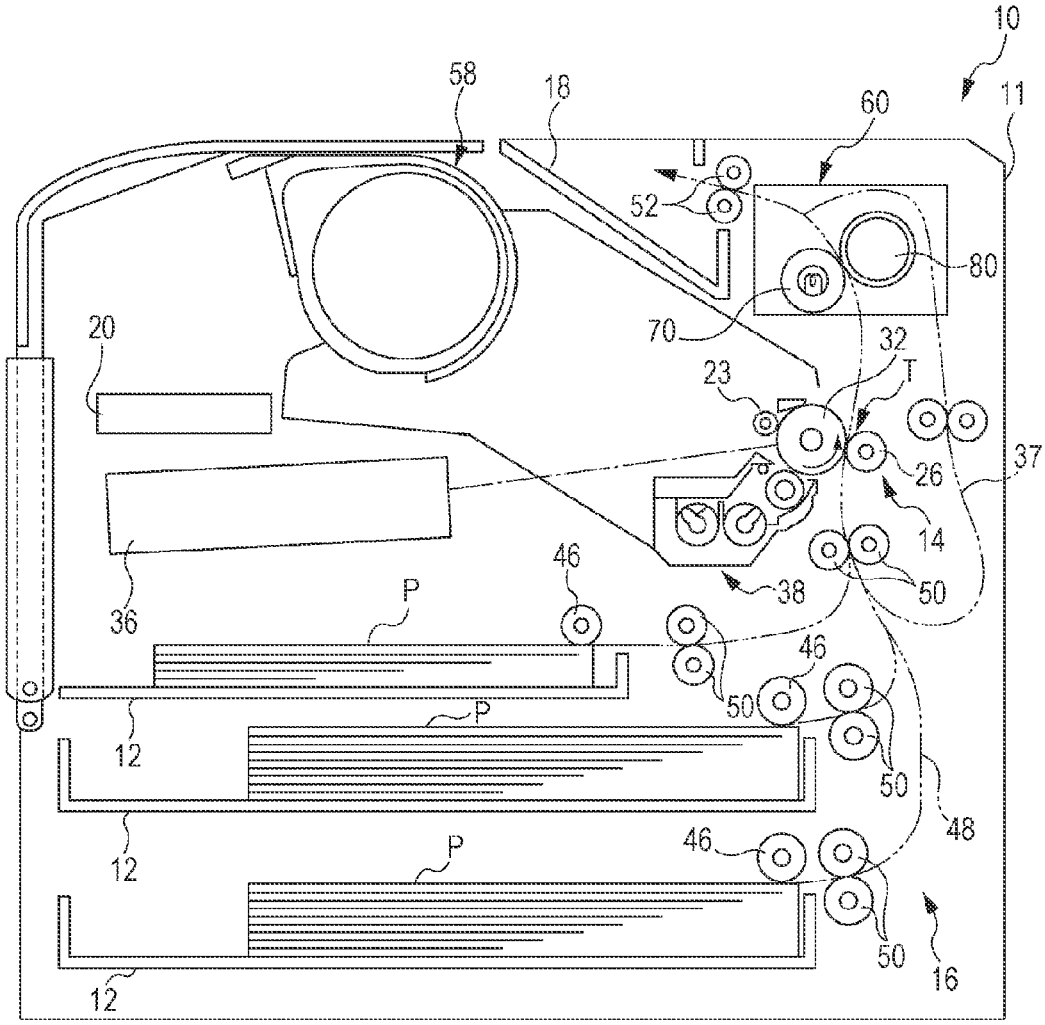
FIG. 1 is a schematic view of the configuration of an image forming apparatus according to this exemplary embodiment.

First, the configuration of an image forming apparatus 10 will be described. FIG. 1 is a schematic view of the configuration of the image forming apparatus 10.

As shown in FIG. 1, the image forming apparatus 10 includes a body 11 accommodating components. The body 11 accommodates containers 12 that store recording media P, such as paper; an image forming section 14 that forms images on the recording media P; a transport section 16 that transports the recording media P from the containers 12 to the image forming section 14; and a controller 20 that controls the operation of the respective parts of the image forming apparatus 10. Furthermore, the body 11 has a discharge portion 18 at an upper part thereof. The recording media P on which images have been formed by the image forming section 14 are discharged on the discharge portion 18.

The image forming section 14 includes a photoconductor drum 32 serving as an image bearing member that bears an image thereon. The photoconductor drum 32 rotates in one direction (for example, counterclockwise in FIG. 1). Around the photoconductor drum 32 are provided, in sequence from an upstream side in the rotation direction of the photoconductor drum 32, a charging roller 23 serving as a charging device that charges the photoconductor drum 32; an exposure device 36 that exposes the photoconductor drum 32, which has been charged by the charging roller 23, to light so that an electrostatic latent image is formed on the photoconductor drum 32; a developing device 38 that develops the electrostatic latent image formed on the photoconductor drum 32 by the exposure device 36, forming a black toner image; and a transfer roller 26, which is an exemplary transfer portion, that transfers the black toner image formed on the photoconductor drum 32 by the developing device 38 to a recording medium P.

The exposure device 36 forms an electrostatic latent image according to an image signal transmitted from the controller 20. The controller 20 may obtain the image signal from an external device.

A toner cartridge 58 serving as a toner container that contains toner is provided above the exposure device 36. The toner in the toner cartridge 58 is transported to the developing device 38 by a toner transport device (not shown).

The transfer roller 26 and the photoconductor drum 32 face each other and transport a recording medium P, nipped therebetween, upward. The nip between the transfer roller 26 and the photoconductor drum 32 constitutes a transfer position T, where a toner image formed on the photoconductor drum 32 is transferred to the recording medium P.

The transport section 16 includes feed rollers 46 that feed a recording medium P stored in the containers 12; transport paths 48 along which the recording medium P fed by the feed rollers 46 is transported; and transportation rollers 50 that are arranged along the transport paths 48 and transport the recording medium P, fed by the feed rollers 46, to the transfer position T.

A fixing device 60 that fixes the toner image transferred to the recording medium P by the transfer roller 26 onto the recording medium P is provided above the transfer position T (on the downstream side in a transporting direction). Discharge rollers 52 that discharge the recording medium P, onto which the toner image has been fixed, onto the discharge portion 18 is provided above the fixing device 60 (on the downstream side in the transporting direction). The detailed configuration of the fixing device 60 will be described below.

Furthermore, an inverting transport path 37 in which the recording medium P with the toner image fixed on one side thereof is inverted and sent back to the transfer position T is provided on the opposite side of the transfer roller 26 across from the photoconductor drum 32 (on the right side in FIG. 1). When forming images on both sides of the recording medium P, the recording medium P with the toner image fixed on one side thereof is switched back by the discharge rollers 52 and is sent back to the transfer position T along the inverting transport path 37.

Image Forming Operation

Next, an image forming operation of the image forming apparatus 10 to form an image onto a recording medium P will be described.

In the image forming apparatus 10, a recording medium P fed from one of the containers 12 by the feed rollers 46 is sent to the transfer position T by the transportation rollers 50.

In the mean time, in the image forming section 14, the photoconductor drum 32 is charged by the charging roller 23 and is exposed to light by the exposure device 36. Thus, an electrostatic latent image is formed on the photoconductor drum 32. The electrostatic latent image is then developed by the developing device 38 to form a black toner image on the photoconductor drum 32. The black toner image is transferred to the recording medium P by the transfer roller 26 at the transfer position T.

The recording medium P, to which the toner image has been transferred, is transported to the fixing device 60, where the toner image is fixed. When an image is to be formed only on one side of the recording medium P, the recording medium P is discharged onto the discharge portion 18 by the discharge rollers 52 after the toner image is fixed.

When images are to be formed on both sides of the recording medium P, after an image is formed on one side thereof, the recording medium P is switched back by the discharge rollers 52 and is sent to the inverting transport path 37 in an inverted state. The recording medium P is then sent from the inverting transport path 37 again to the transfer position T, where an image is formed on the other side (unprinted side) in the same way as above, and is discharged onto the discharge portion 18 by the discharge rollers 52. The image forming operation is performed in this manner.

Configuration of Fixing Device

Figure 2:
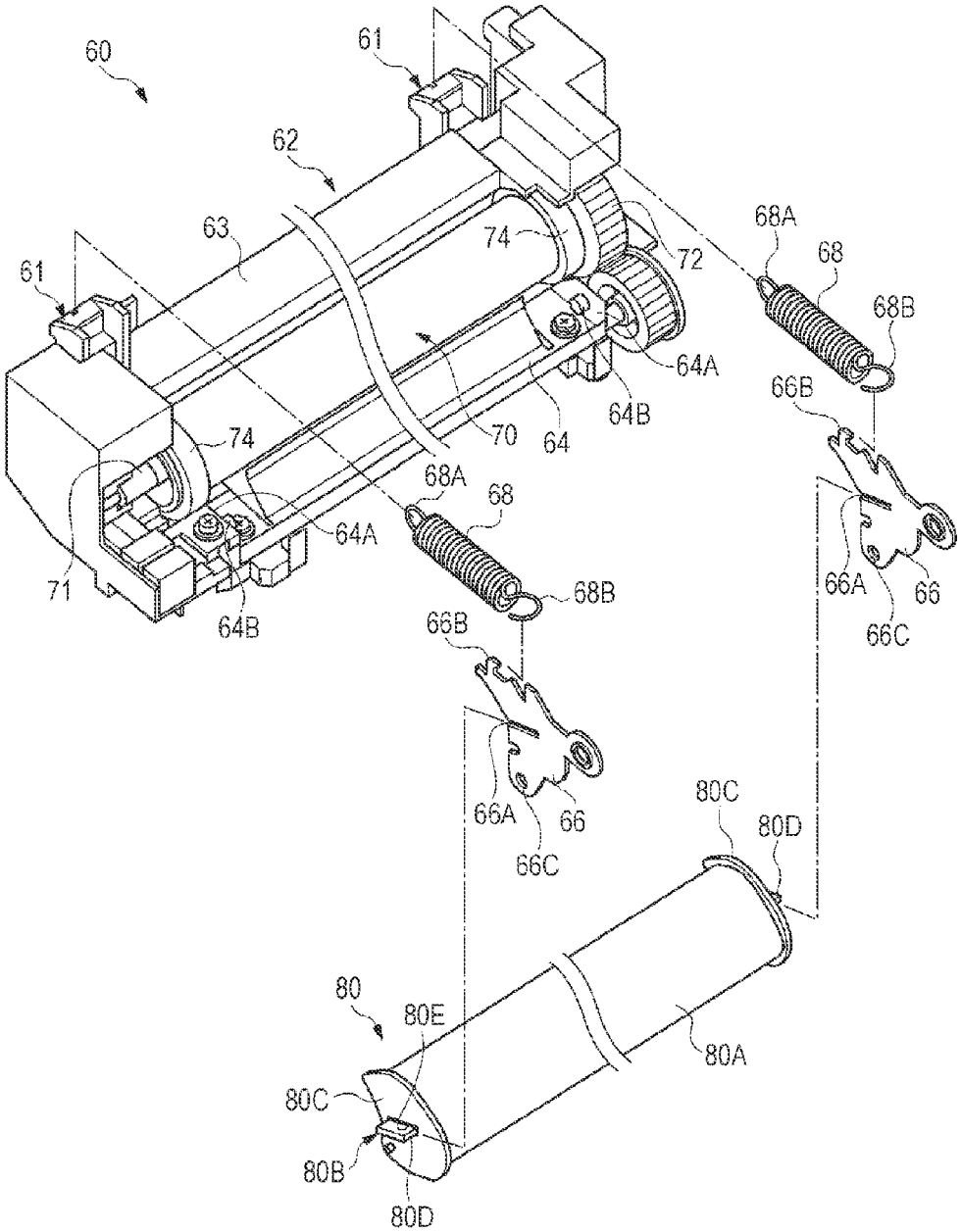
FIG. 2 is an exploded perspective view of a portion of the configuration of a fixing device according to this exemplary embodiment.
Figure 3:
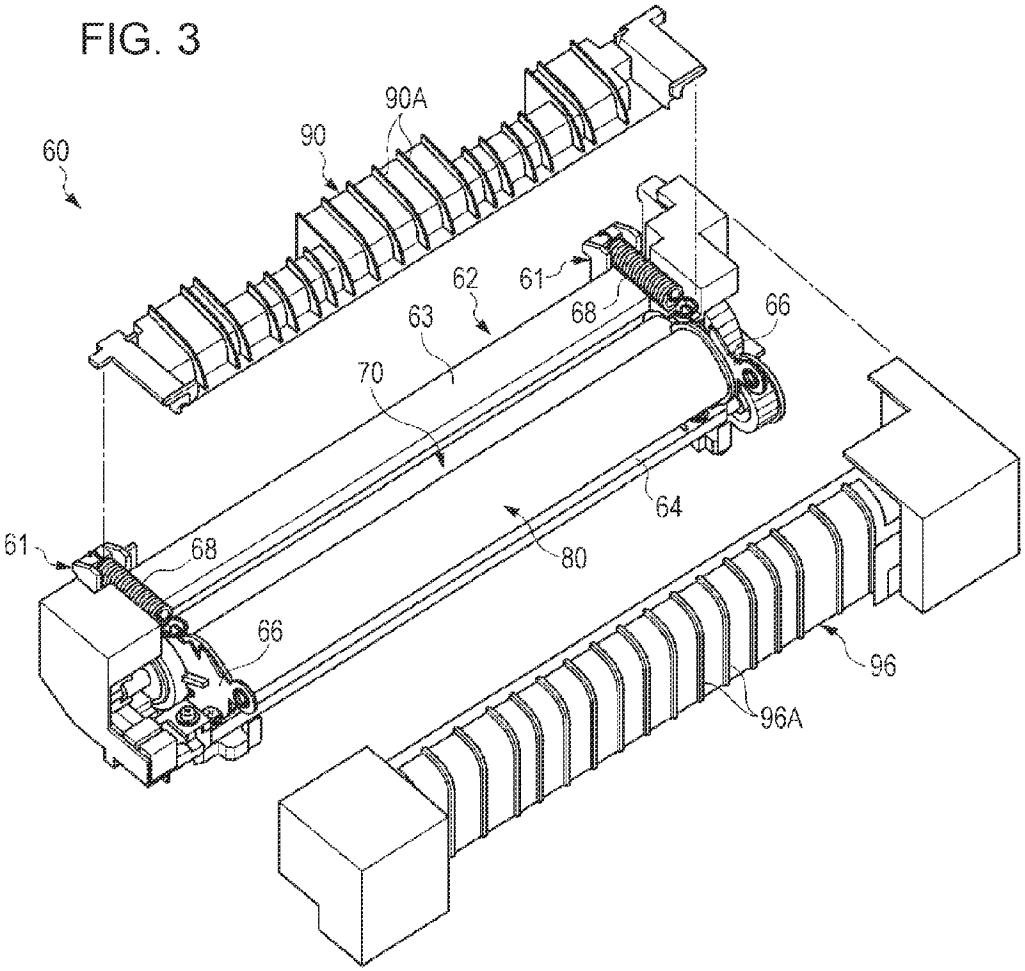
FIG. 3 is an exploded perspective view of the configuration of the fixing device according to this exemplary embodiment.
Figure 4:
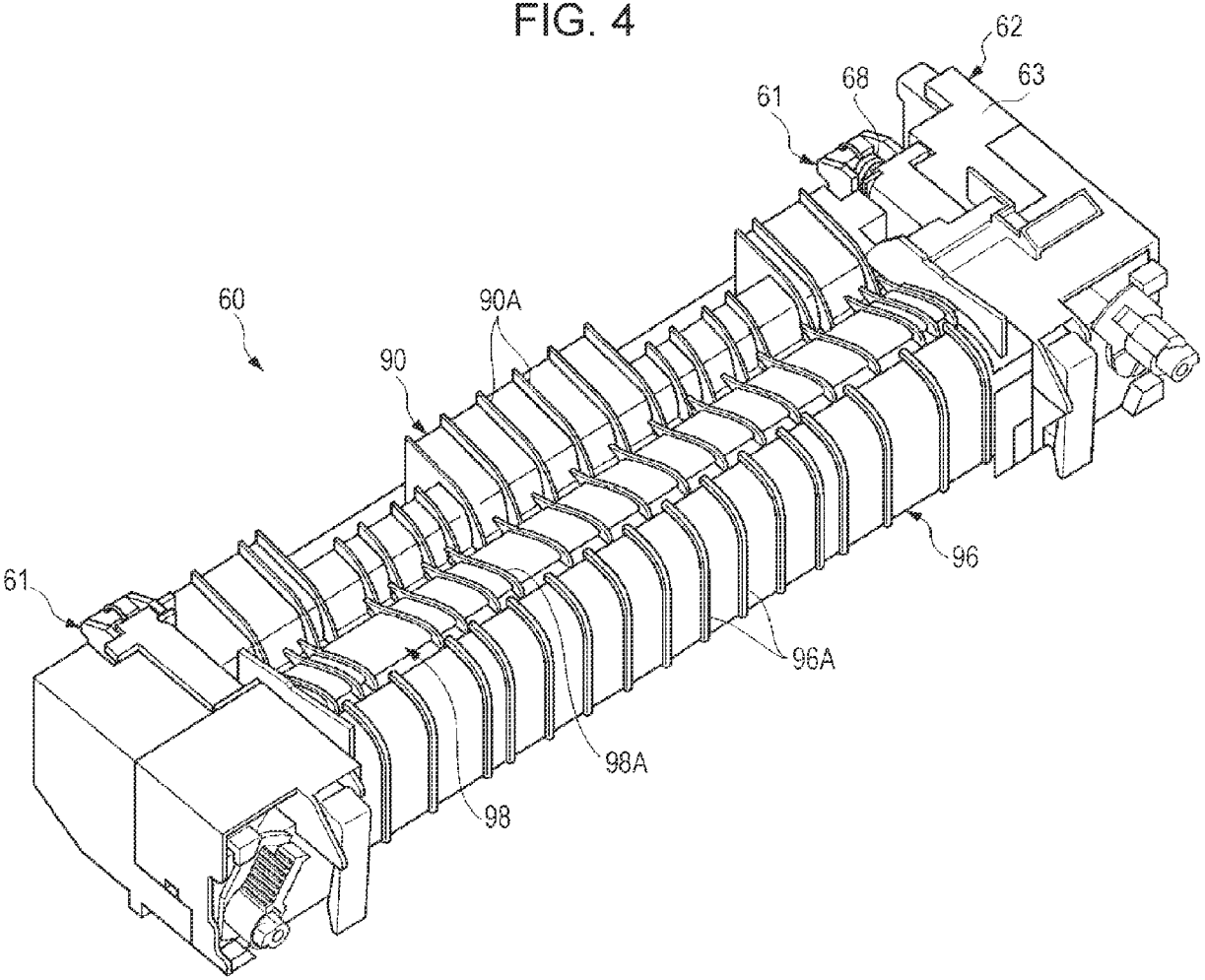
FIG. 4 is a perspective view of the configuration of the fixing device according to this exemplary embodiment.

Next, the configuration of the fixing device 60 according to this exemplary embodiment will be described. FIGS. 2 to 4 show the configuration of the fixing device 60 according to this exemplary embodiment.

As shown in FIG. 2, the fixing device 60 according to this exemplary embodiment includes a heating roller 70, which is an exemplary heating member; a pressure belt 80 serving as a pressure member; a roller support member 62 serving as a first support portion that supports the heating roller 70; and a pair of belt support plates 66 serving as a second support portion that supports the pressure belt 80.

Figure 5:
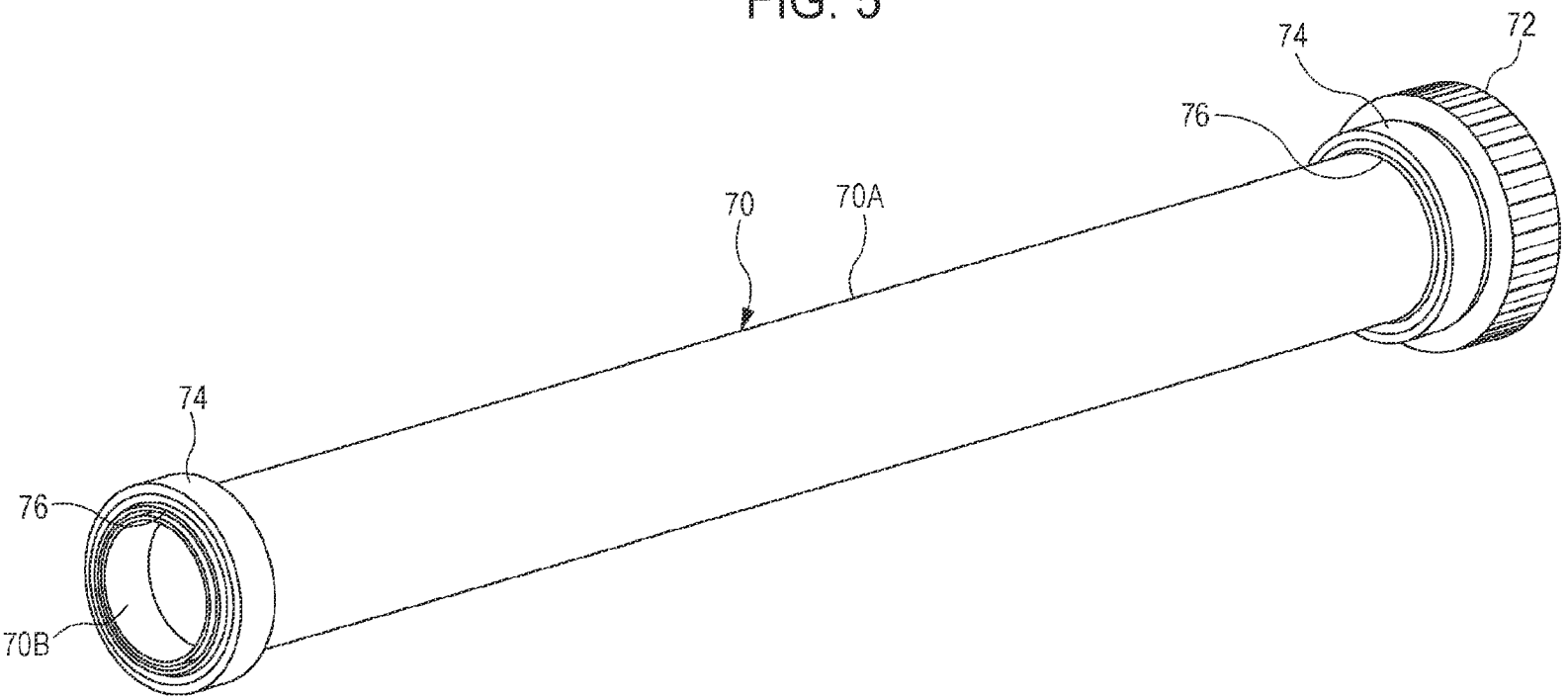
FIG. 5 is a perspective view of the configuration of a heating roller according to this exemplary embodiment.

The heating roller 70 is composed of a hollow cylindrical member (roller portion) (see FIG. 5). The heating roller 70 accommodates a heat source 71, such as a halogen lamp, therein. Axial ends of the heat source 71 project from axial ends of the heating roller 70 and are fixed to the roller support member 62.

The axial ends of the heating roller 70 are rotatably supported by the roller support member 62 via bearings 74 (described below). The heating roller 70 is rotated by a rotational force transmitted from a driving motor (not shown) via a gear 72 fixed to one axial end thereof. The detailed configuration of the heating roller 70 and a support structure for the heating roller 70 will be described below.

The roller support member 62 includes a support member body 63 elongated in the axial direction of the heating roller 70, and first engaging portions 61 provided at longitudinal ends of the support member body 63, with which ends of tension springs 68, serving as elastic members, are to be engaged.

An introduction guide member (introduction chute) 64 that guides the recording medium P to a contact region (nip) between the heating roller 70 and the pressure belt 80 is screwed to the lower part of the roller support member 62. Posts 64B that rotatably support the pair of belt support plates 66 are provided on inner surfaces of side walls 64A of the introduction guide member 64.

The pressure belt 80 includes an endless belt 80A, a support member 80B that is provided on the inner circumference of the endless belt 80A to support the endless belt 80A, and side plates 80C fixed to ends of the support member 80B.

The support member 80B is elongated in the axial direction of the endless belt 80A and has projections 80D projecting from axial ends of the endless belt 80A. The side plates 80C protrude radially outward of the endless belt 80A to suppress axial movement of the pressure belt 80. Furthermore, the side plates 80C have through holes 80E through which the projections 80D of the support member 80B pass.

The pair of belt support plates 66 have insertion slots 66A into which the projections 80D of the support member 80B are to be inserted. The insertion slots 66A are open at the heating roller 70 side. By inserting the projections 80D of the support member 80B into the insertion slots 66A, the pressure belt 80 is supported by the pair of belt support plates 66.

The pair of belt support plates 66 also have insertion holes 66C into which the posts 64B of the introduction guide member 64 are to be inserted. By inserting the posts 64B of the introduction guide member 64 into the insertion holes 66C, the pair of belt support plates 66 are supported so as to be rotatable about the posts 64B of the introduction guide member 64. Thus, the pair of belt support plates 66 are movable with respect to the roller support member 62 such that the pressure belt 80 comes into contact with or moves away from the heating roller 70.

The pair of belt support plates 66 also have second engaging portions 66B with which the other ends of the tension springs 68 are to be engaged. The second engaging portions 66B are projections with which hooks 68B provided at the other ends of the tension springs 68 are to be engaged.

The tension springs 68 pull the pair of belt support plates 66 and the roller support member 62 by an elastic force to press the pressure belt 80 against the heating roller 70. Thus, the contact region (nip) is formed between the heating roller 70 and the pressure belt 80.

The pressure belt 80 pressed against the heating roller 70 is rotated by the heating roller 70 that is rotationally driven. As a result, the heating roller 70 and the pressure belt 80 nip and transport the recording medium P, to which the toner image has been transferred, while heating the recording medium P (toner) with the heating roller 70 and pressing the recording medium P (toner) with the pressure belt 80. Thus, the toner image is fixed.

As shown in FIGS. 3 and 4, the fixing device 60 further includes a discharge guide member (discharge chute) 90 that guides the recording medium P discharged from the contact region between the heating roller 70 and the pressure belt 80 to the discharge rollers 52, and a covering 96 serving as a covering member that covers a portion, in the circumferential direction, of the pressure belt 80.

The discharge guide member 90 has ribs 90A extending in a recording-medium transporting direction on the top surface thereof. The discharge guide member 90 covers a portion, in the circumferential direction, of the heating roller 70 and constitutes an outer wall of the fixing device 60.

The covering 96 has ribs 96A extending in the recording-medium transporting direction on the outer surface thereof. The outer surface of the covering 96 constitutes a portion of a transport surface of the inverting transport path 37 (see FIG. 1) and constitutes the outer wall of the fixing device 60.

Furthermore, as shown in FIG. 4, a detection member 98 that detects the recording medium P transported from the contact region (nip) between the heating roller 70 and the pressure belt 80 to the discharge rollers 52 is provided between the discharge guide member 90 and the covering 96. The detection member 98 has ribs 98A extending in the recording-medium transporting direction on the top and bottom surfaces thereof. The detection member 98 is not shown in FIG. 3.

Detailed Configuration of Heating Roller and Support Structure for Heating Roller Next, the detailed configuration of the heating roller 70 and a support structure for the heating roller 70 will be described.

Figure 6:
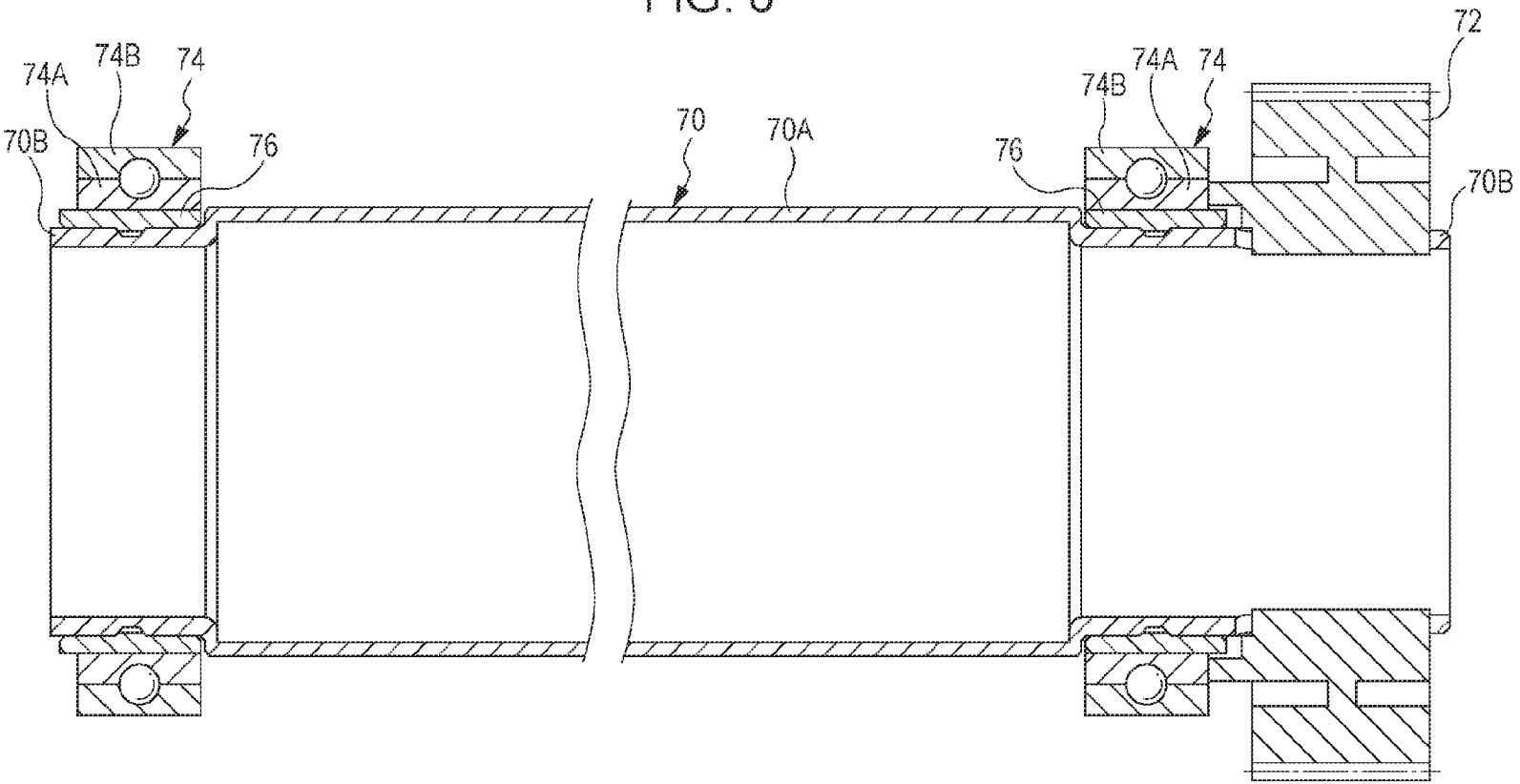
FIG. 6 is a sectional view of the configuration of the heating roller according to this exemplary embodiment.

The heating roller 70 is made of metal, such as aluminum, iron, or stainless steel, and includes a roller body 70A and shaft portions 70B provided at axial ends of the roller body 70A coaxially therewith, as shown in FIGS. 5 and 6. A separation layer (not shown) that facilitates separation of the recording medium P is provided on the outer circumference of the roller body 70A. The separation layer is made of, for example, resin, such as fluorocarbon resin.

Figure 7:
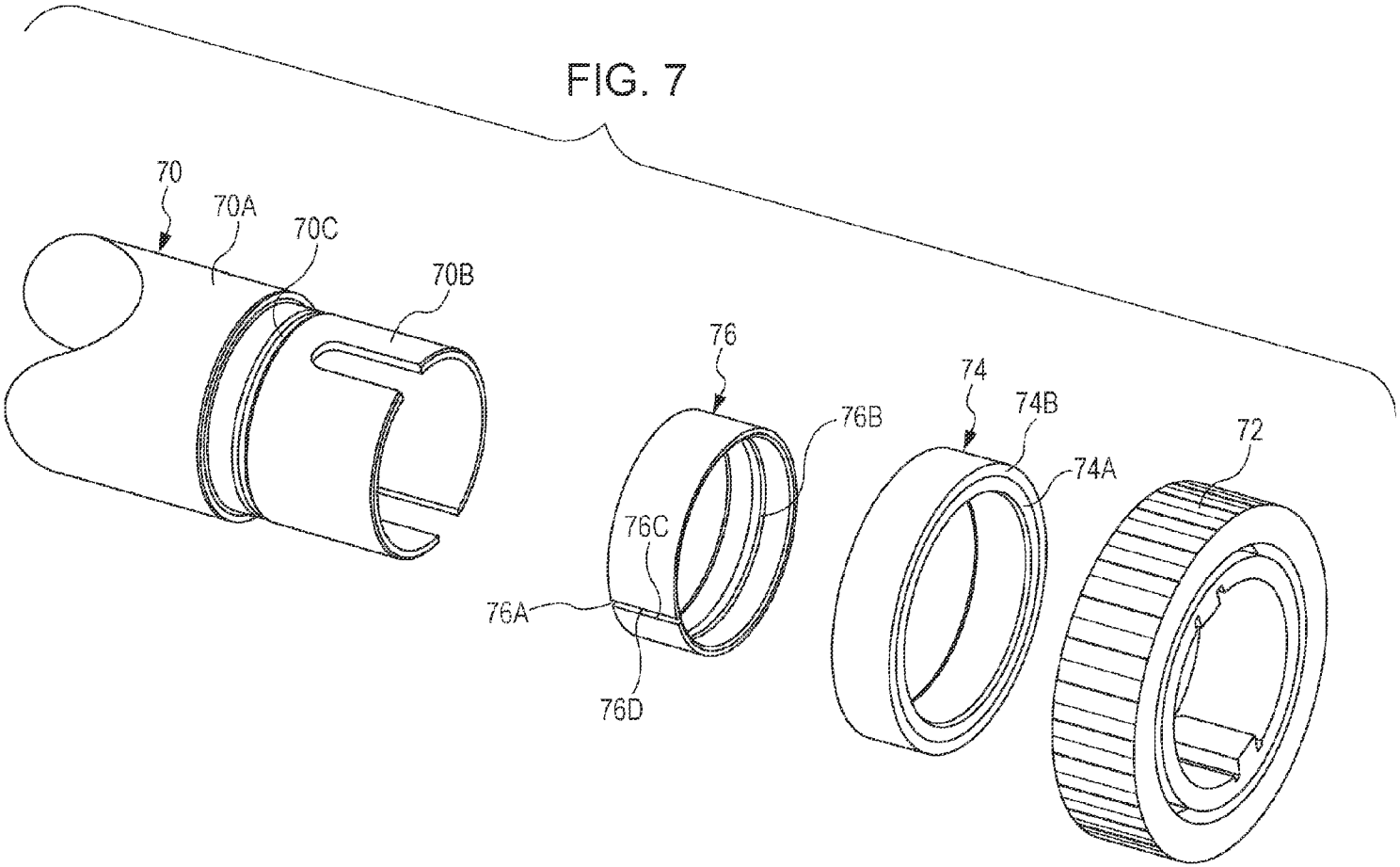
FIG. 7 is an exploded perspective view of the configuration of an axial end of the heating roller according to this exemplary embodiment.
Figure 8:
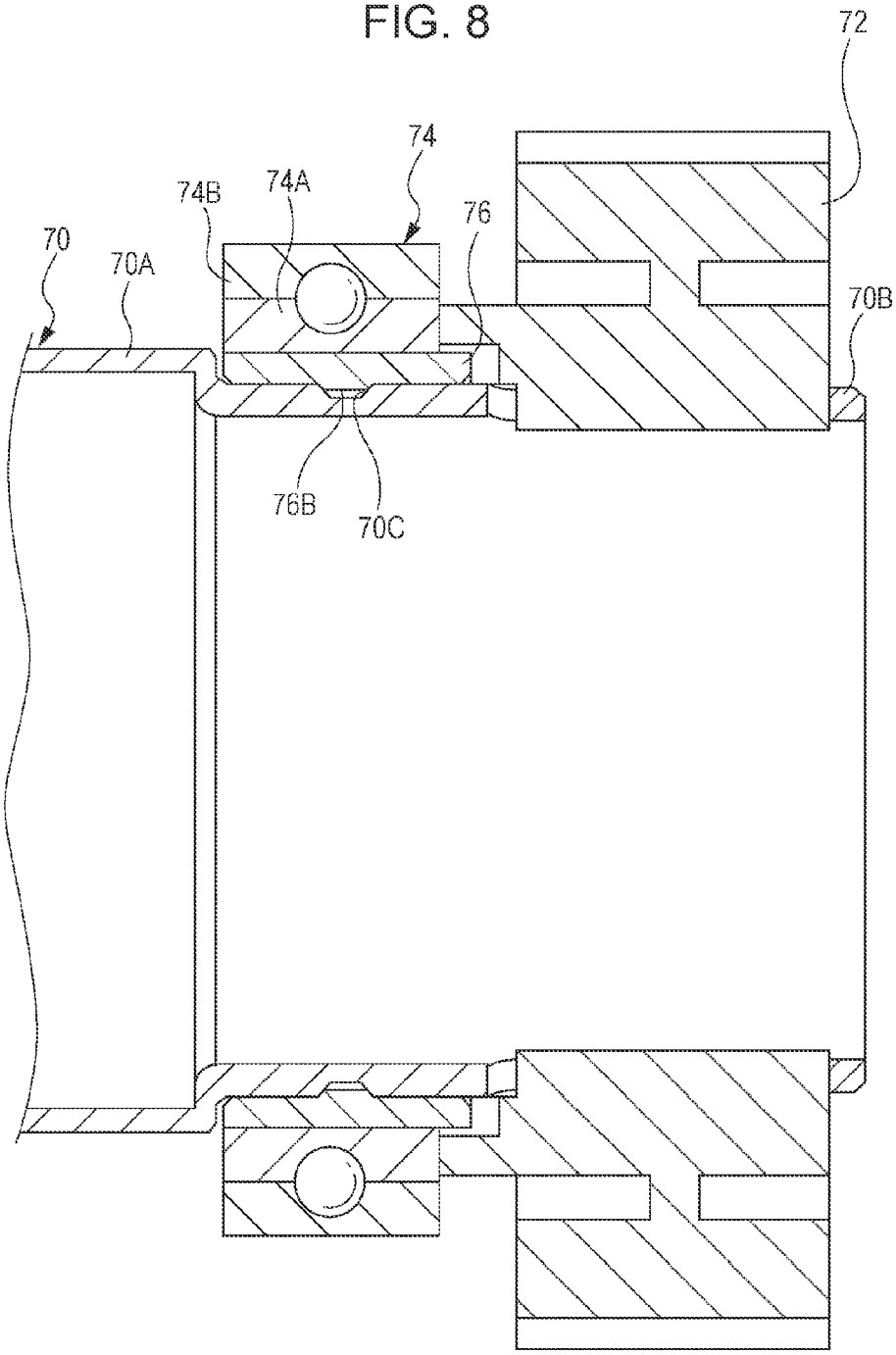
FIG. 8 is a sectional view of the configuration of the axial end of the heating roller according to this exemplary embodiment.

The shaft portions 70B are formed in a hollow cylindrical shape having a smaller outside diameter than the roller body 70A and are supported by the bearings 74 described below. As shown in FIG. 7, the shaft portions 70B have grooves 70C, which are exemplary recesses, extending over the entire outer circumferences thereof. The grooves 70C are continuous over the entire outer circumferences of the shaft portions 70B in a circular shape. Furthermore, as shown in FIG. 8, the grooves 70C have a trapezoidal shape in circumferential cross-section.

As shown in FIG. 7, heat insulating sleeves 76, which are exemplary ring-shaped heat insulating members, are fitted to the shaft portions 70B. The heat insulating sleeves 76 are made of heat-resistant resin, such as polyimide resin, and suppress the heat of the heating roller 70 being transmitted to the bearings 74 described below.

The heat insulating sleeves 76 each have an axially provided slit 76A, which is an exemplary cut out portion. Because of the slit 76A, one end surface 76C and the other end surface 76D, in the circumferential direction, of the heat insulating sleeve 76 face each other with the slit 76A therebetween. The heat insulating sleeve 76 is deformable such that the distance between the one end surface 76C and the other end surface 76D increases.

Furthermore, the heat insulating sleeves 76 have ridges 76B, which are exemplary projections, that extend over the entire inner circumferences thereof and fit into the grooves 70C in the heating roller 70. More specifically, the ridges 76B have a C shape continuous from the one end surface 76C to the other end surface 76D of the heat insulating sleeves 76. The ridges 76B are formed axially in the middle of the heat insulating sleeves 76. Furthermore, as shown in FIG. 8, the ridges 76B have a trapezoidal shape in circumferential cross-section. A pair of oblique lines of the trapezoid observed in the cross-sectional view of the ridges 76B are in contact with the oblique lines of the trapezoid observed in the cross-sectional view of the grooves 70C.

When the heat insulating sleeves 76 are fitted to the shaft portions 70B of the heating roller 70, because the ridges 76B are formed on the inner circumferences thereof, the heat insulating sleeves 76 are deformed such that the distance between the one end surface 76C and the other end surface 76D is increased.

Furthermore, because the heat insulating sleeves 76 are disposed between the shaft portions 70B and the bearings 74, the heat insulating sleeves 76 are kept fitted to the shaft portions 70B of the heating roller 70 even though the grooves 70C and the ridges 76B are not deeply engaged with each other. The depth of the grooves 70C is, for example, 0.3 mm, and the height of the ridges 76B is, for example, 0.2 mm.

As shown in FIG. 7, the support member body 63 of the roller support member 62 (see FIG. 2) is provided with the bearings 74 that rotatably support the shaft portions 70B provided at the axial ends of the heating roller 70 via the heat insulating sleeves 76.

More specifically, the bearings 74 are formed of ring-shaped ball bearings composed of metal, such as stainless steel. Inner rings 74A of the bearings 74 are fitted to the outer circumferences of the heat insulating sleeves 76, and outer rings 74B of the bearings 74 are fixed to the support member body 63.

In this exemplary embodiment, the heat insulating sleeves 76 do not have rotation-preventing members that inhibit circumferential movement thereof relative to the heating roller 70. Therefore, the heat insulating sleeves 76 are able to circumferentially rotate relative to the heating roller 70. However, because the sliding characteristics (the ease of rotation) of the heat insulating sleeves 76 relative to the heating roller 70 are lower than the sliding characteristics (the ease of rotation) of the inner rings 74A relative to the outer rings 74B (balls) of the bearings 74, the heat insulating sleeves 76 do not rotate relative to the heating roller 70 when the heating roller 70 is rotated.

Operations of this Exemplary Embodiment

Next, operations of this exemplary embodiment will be described.

In this exemplary embodiment, when producing the heating roller 70, cutting processing (for example, lathe machining) is performed on the outer circumferential surface of the heating roller 70 while rotating the heating roller 70 (the material of the heating roller 70).

The cutting processing is performed to achieve a desired thickness and shape of the heating roller 70. Examples of the desired shape of the heating roller 70 include an hourglass shape, i.e., a shape in which the outside diameter of the heating roller 70 is larger at the axial ends than at the middle thereof. The cutting processing is performed also to roughen the outer circumferential surface of the heating roller 70 to increase the adhesion of the resin (for example, fluorocarbon resin) serving as the separation layer (release layer).

Because the grooves 70C are formed over the entire circumferences of the shaft portions 70B, the grooves 70C are formed simultaneously with the cutting processing.

Because this exemplary embodiment does not require the process just for forming the grooves 70C, the number of steps in manufacturing the heating roller 70 is reduced. Thus, the number of steps in manufacturing the fixing device 60 and the image forming apparatus 10 is reduced.

In this exemplary embodiment, because the heat insulating sleeves 76 have the slits 76A, portions, in the circumferential direction, of the heat insulating sleeves 76 are more likely to be axially deformed than the other portions, in the circumferential direction, of the heat insulating sleeves 76. In particular, the end surfaces 76C of the heat insulating sleeves 76 are likely to be axially displaced with respect to the other end surfaces 76D, causing the heat insulating sleeves 76 to be deformed in a spiral shape. However, in this exemplary embodiment, because the ridges 76B are formed over the entire circumferences of the heat insulating sleeves 76, axial deformation of the portions, in the circumferential direction, of the heat insulating sleeves 76 with respect to the other portions, in the circumferential direction, thereof is suppressed. In particular, because the ridges 76B are formed over the entire circumferences of the heat insulating sleeves 76 in this exemplary embodiment, axial deformation of the heat insulating sleeves 76 over the entire circumferences thereof is suppressed. As a result, stable fit between the heat insulating sleeves 76 and the heating roller 70 is achieved, and unusual noise is suppressed.

Furthermore, in this exemplary embodiment, because the ridges 76B are formed axially in the middle of the heat insulating sleeves 76, the heat insulating sleeves 76 may be fitted to the axial ends of the heating roller 70 from either axial ends of the heat insulating sleeves 76. Thus, the ease of assembly of the heating roller 70 is improved.

Modification

Although the ridges 76B are formed over the entire circumferences of the heat insulating sleeves 76 in this exemplary embodiment, the ridges 76B may be circumferentially formed on the heat insulating sleeves 76 in an intermittent configuration. The ridges 76B may be circumferentially formed on, at least, portions of the heat insulating sleeves 76.

Although the heating roller 70 has a hollow cylindrical shape in this exemplary embodiment, the heating roller 70 may have a solid cylindrical shape.

Although the ridges 76B are formed axially in the middle of the heat insulating sleeves 76 in this exemplary embodiment, the ridges 76B may be formed at positions axially shifted therefrom.

Figure 9:
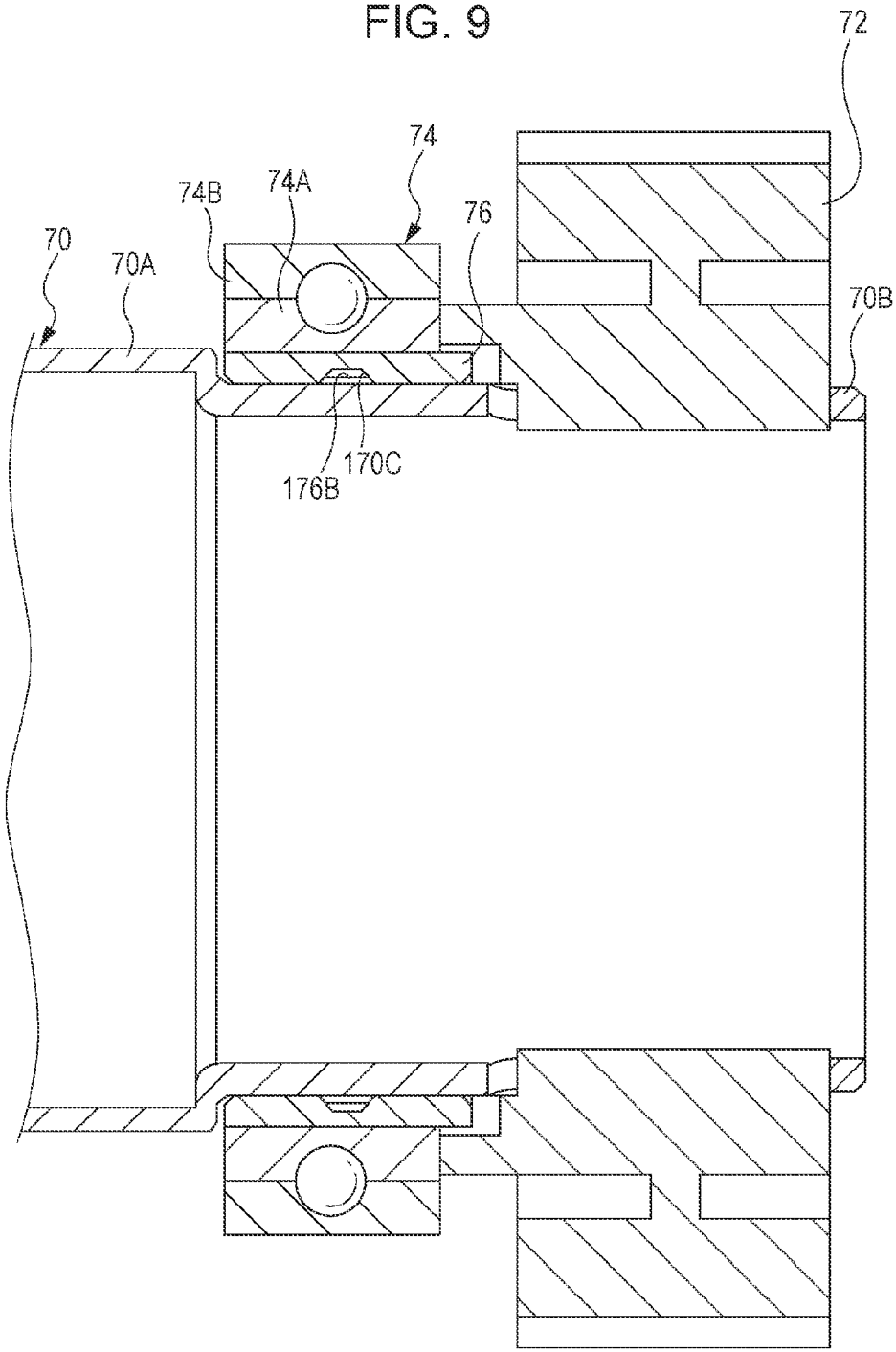
FIG. 9 is a sectional view of the configuration of an axial end of a heating roller according to a modification.

In this exemplary embodiment, the grooves 70C are provided in the shaft portions 70B of the heating roller 70, and the ridges 76B to fit into the grooves 70C are formed on the heat insulating sleeves 76. However, as shown in FIG. 9, ridges 176B, which are exemplary projections, may be formed on the shaft portions 70B of the heating roller 70, and grooves 170C, which are exemplary recesses and receive the ridges 176B, may be provided in the heat insulating sleeves 76.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a solid or hollow cylindrical heating member that heats a recording medium and has at least one recess or projection provided on at least one end of axial ends thereof, on the outer circumference;

a ring-shaped heat insulating member to be fitted to the axial ends of the heating member, the ring-shaped heat insulating member having, an inner circumference which has an inner surface thereon, at least one projection or recess axially formed on the inner surface of the inner circumference to fit into or receive the at least one recess or projection provided on the heating member; and a bearing that is configured to rotatably support the at least one end of the axial ends of the heating member via the heat insulating member.

2. The fixing device according to claim 1, wherein the heat insulating member has an axially extending cut out portion, and the at least one projection or recess provided on the heat insulating member extends over the entire circumferences of the heat insulating member.

3. The fixing device according to claim 1, wherein the at least one projection or recess provided on the heat insulating member is positioned axially in the middle of the heat insulating member.

4. The fixing device according to claim 2, wherein the at least one projection or recess provided on the heat insulating member is positioned axially in the middle of the heat insulating member.

5. An image forming apparatus comprising:

a transfer portion that transfers an image to a recording medium; and the fixing device according to claim 1 that fixes the image transferred by the transfer portion onto the recording medium.

6. An image forming apparatus comprising:

a transfer portion that transfers an image to a recording medium; and the fixing device according to claim 2 that fixes the image transferred by the transfer portion onto the recording medium.

7. An image forming apparatus comprising:

a transfer portion that transfers an image to a recording medium; and the fixing device according to claim 3 that fixes the image transferred by the transfer portion onto the recording medium.

8. An image forming apparatus comprising:

a transfer portion that transfers an image to a recording medium; and the fixing device according to claim 4 that fixes the image transferred by the transfer portion onto the recording medium.

9. The fixing device according to claim 1, wherein the at least one recess or projection of the solid or hollow cylindrical heating member and the at least one projection or recess of the ring-shaped heat insulating member have an overlap with the bearing in an axial direction of the radius of the solid or hollow cylindrical heating member.

10. A fixing roller comprising:

a solid or hollow cylindrical heating member that heats a recording medium and has at least one recess or projection provided on at least one end of axial ends thereof, on the outer circumference;

a ring-shaped heat insulating member to be fitted to the at least one end of the axial ends of the heating member, the ring-shaped heat insulating member having, an inner circumference which has an inner surface thereon, at least one projection or recess axially formed on the inner surface of the inner circumference to fit into or receive the at least one recess or projection provided on the heating member; and a bearing that is configured to rotatably support at least one end of the axial ends of the heating member via the heat insulating member.

* * * * *